US008881475B2

(12) United States Patent
Lewis

(10) Patent No.: US 8,881,475 B2
(45) Date of Patent: Nov. 11, 2014

(54) FLOOR JOIST STRENGTHENING AND UTILITY CONDUIT ORGANIZING SYSTEM

(76) Inventor: Raymond J. Lewis, Weaverville, NC (US)

( * ) Notice: Subject to any disclaimer, the term of this patent is extended or adjusted under 35 U.S.C. 154(b) by 374 days.

(21) Appl. No.: 13/361,048

(22) Filed: Jan. 30, 2012

(65) Prior Publication Data

US 2013/0192152 A1 Aug. 1, 2013

(51) Int. Cl.
*E04B 5/00* (2006.01)
*E04B 5/48* (2006.01)

(52) U.S. Cl.
CPC ..... *E04B 5/48* (2013.01)
USPC ..... 52/220.2; 52/220.8; 52/650.1; 52/655.1; 248/49; 248/68.1

(58) Field of Classification Search
CPC ..... E04B 5/48; F16L 3/00; H02G 3/00
USPC ..... 52/220.2, 220.6, 220.7, 220.8, 650.1, 52/655.1; 248/49, 681
See application file for complete search history.

(56) References Cited

U.S. PATENT DOCUMENTS

| | | | | |
|---|---|---|---|---|
| 1,848,085 | A | 3/1932 | Eisenschmidt | |
| 2,567,586 | A | 9/1951 | Werder | |
| 2,686,643 | A * | 8/1954 | Bloom et al. | 248/49 |
| 2,911,022 | A | 11/1959 | Brown | |
| 4,165,067 | A | 8/1979 | Jernigan | |
| 4,596,095 | A | 6/1986 | Chalfant | |
| 5,237,786 | A * | 8/1993 | Kochansky | 52/126.4 |
| 5,615,850 | A * | 4/1997 | Cloninger | 248/68.1 |
| 5,827,441 | A * | 10/1998 | Solbjorg | 249/91 |
| 5,992,802 | A * | 11/1999 | Campbell | 248/68.1 |
| D423,325 | S | 4/2000 | Liss | |
| 6,170,217 | B1 | 1/2001 | Meyer | |
| 6,301,854 | B1 | 10/2001 | Daudet et al. | |
| 6,390,421 | B1 * | 5/2002 | Rudd | 248/68.1 |
| 6,402,096 | B1 * | 6/2002 | Ismert et al. | 248/68.1 |
| 6,412,233 | B1 | 7/2002 | Jones | |
| 7,223,052 | B1 * | 5/2007 | Evans | 405/184.4 |
| 7,310,914 | B1 | 12/2007 | Moore | |
| 7,828,251 | B2 * | 11/2010 | Tollefson | 248/68.1 |
| 8,033,511 | B2 | 10/2011 | Grivas et al. | |
| D664,025 | S * | 7/2012 | Horn | D8/354 |
| 8,376,290 | B2 * | 2/2013 | Tollefson | 248/68.1 |
| 8,635,820 | B2 * | 1/2014 | Lafferty et al. | 52/293.3 |
| 2005/0258315 | A1 | 11/2005 | Bigham | |
| 2006/0096197 | A1 * | 5/2006 | Tollefson | 52/223.13 |
| 2007/0090231 | A1 | 4/2007 | MacDuff | |
| 2010/0326008 | A1 | 12/2010 | Bigham | |
| 2013/0133282 | A1 * | 5/2013 | Cave et al. | 52/650.1 |

* cited by examiner

*Primary Examiner* — William Gilbert
*Assistant Examiner* — Alp Akbasli
(74) *Attorney, Agent, or Firm* — Dority & Manning, PA

(57) ABSTRACT

There is provided an apparatus for strengthening floor structures and for organizing utility conduits. The apparatus includes a rectangular shaped web having first and second opposing sides. The web bridges between two adjacent floor joists and is perpendicular to the adjacent floor joists. A beam is located a predetermined distance from the first side and is parallel to the first side. The beam and the first side form a pocket for receiving a portion of a floor joist. A channel is formed in the second side for receiving a beam from another substantially identical web so that the two webs may be interlocked. The web includes a central portion having a plurality of openings therein for receiving elongated utility conduits.

20 Claims, 5 Drawing Sheets

FLOOR JOIST STRENGTHENING AND UTILITY CONDUIT ORGANIZING SYSTEM

BACKGROUND

This invention relates to residential construction industry practices for building under-floor support structure using joists, methods used to strengthen joist installations, and to the practices of the electrical, plumbing, gasfitter, and heating-cooling trades for installing and affixing their utilities delivery wiring, pipe, conduit, or ducting in under-floor spaces.

In the last several decades, general contractors in the consumer residential construction industry have experienced materials costs rising faster than the average consumer's ability to afford home price increases. This erodes industry profit margins. To compensate, the residential construction industry increasingly builds only to minimum standards and omits construction items not required by building codes. The result is lower quality, less durability, and higher consumer repair costs and lower structural integrity. One area where the impacts are easily noticeable is floor joist construction. Building codes only require sixteen inch spacing even though some experts recommend twelve inch spacing. Some builders do not even achieve the minimum standards completely. The increasing sophistication of utility technologies requires more pipes and wires, which are often routed through holes in joists which further weaken joists. Advisable reinforcing techniques like "bridging," joist hole reinforcing plates, and other related techniques are rarely done anymore. This situation creates a need for cost effective means to improve and evolve on-site floor joist building techniques and technology.

SUMMARY OF THE INVENTION

In accordance with one form of this invention, there is provided an apparatus for bridging between adjacent floor joists. A web having at least two opposing sides and a central portion is provided. The web is adapted to be received between and to make contact with adjacent floor joists. The web is preferably perpendicular to the adjacent floor joists. The central portion of the web includes a plate. The plate has a plurality of openings therein. Each opening is adapted to receive one of a plurality of elongated utility conduits.

In accordance with another form of this invention, there is provided an apparatus for strengthening floor structures and for organizing utility conduits. A rectangular shaped web having first and second opposing sides is provided. The web is adapted to bridge between adjacent floor joists. A beam is located a predetermined distance from the first side of the web. The beam is parallel to the first side of the web. The beam and the first side of the web form a slot for receiving at least a portion of a floor joist. A channel is formed in the second side of the web for receiving a beam from another web wherein the two webs may be interlocked. The web including a central portion having a plurality of openings therein for receiving elongated utility conduits.

In accordance with yet another form of this invention, there is provided a floor joist strengthening and utility conduit organizing system. The system includes at least first and second webs. Each web has first and second opposing sides. Each web further includes a central portion with at least one opening therein for receiving at least one elongated utility conduit. A beam is located a predetermined distance from the first opposing side of each web, forming a slot for receiving at least a portion of a floor joist. Each web has a channel formed in the second opposing side. The channel in the first web receiving the beam of the second web, wherein the first and second webs are interlocked.

BRIEF DESCRIPTION OF THE DRAWINGS

The subject matter which is regarded as the invention is set forth in the independent claims. The invention, however, may be better understood in reference to the accompanying drawings in which:

DESCRIPTION OF THE PREFERRED EMBODIMENTS

Figure 1:
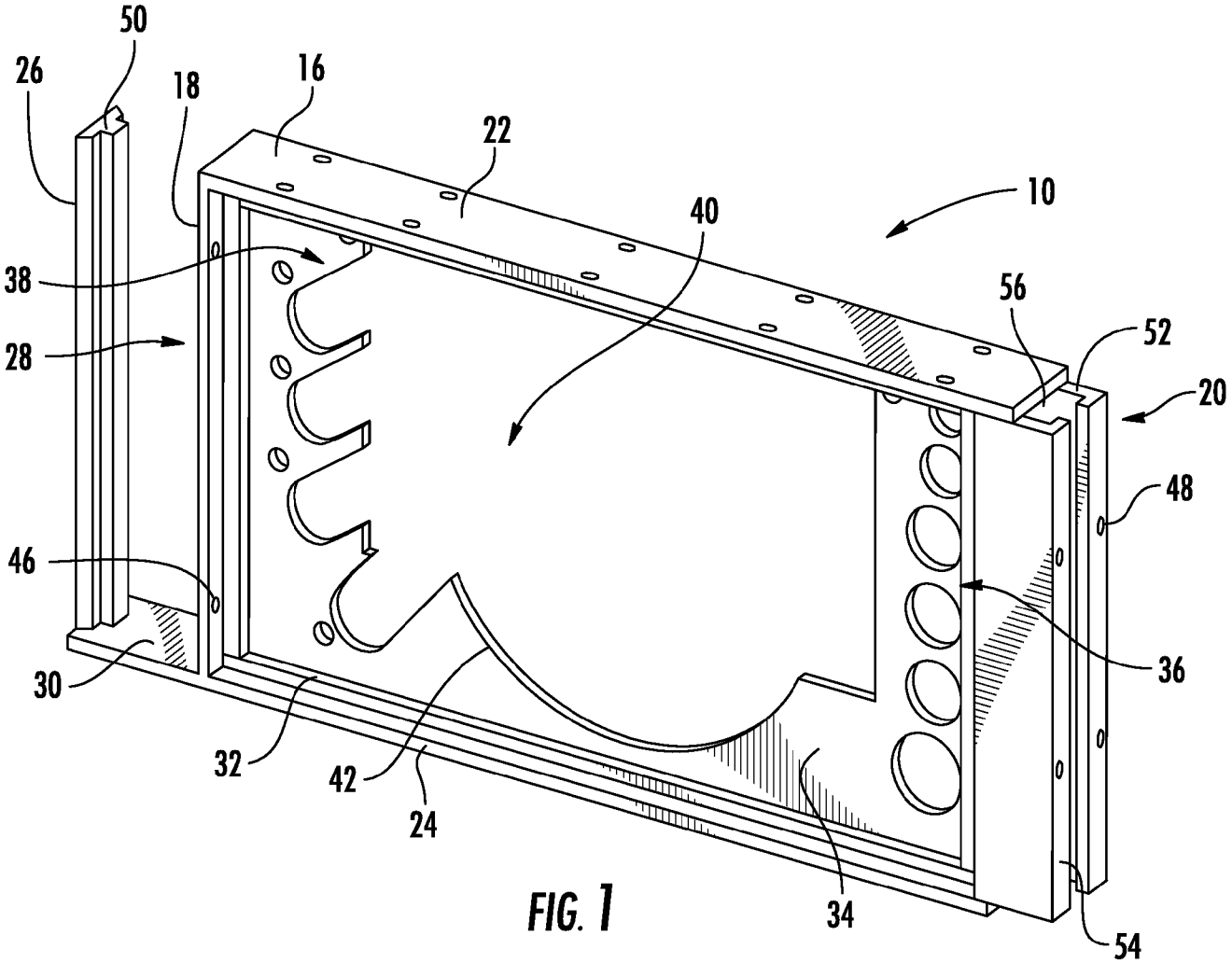
FIG. 1 is a front perspective view showing a single web which embodies the invention.
Figure 5:
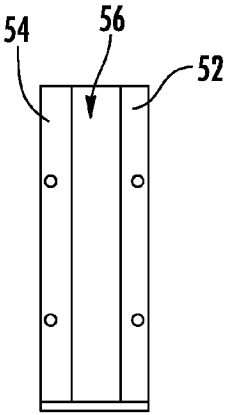
FIG. 5 is a right side elevational view of the embodiment of FIG. 1.
Figure 3:
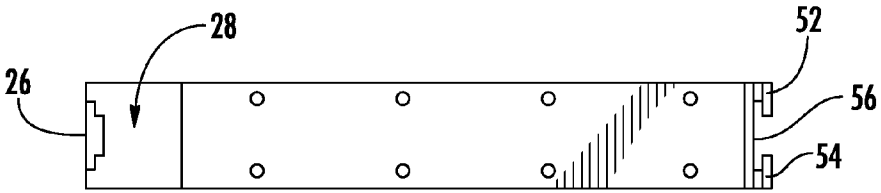
FIG. 3 is a top view of the embodiment of FIG. 1.
Figure 2:
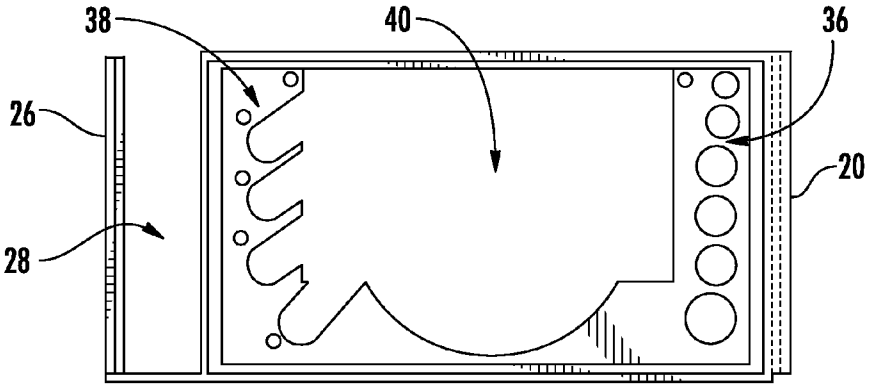
FIG. 2 is a front elevational view of the embodiment of FIG. 1.

The invention includes a pre-engineered rectangular support installed perpendicular to adjacent floor joists and exactly fills the horizontal distance between two parallel joists with a distance that results in sixteen inches on center of the joists. Moreover, each web can interlock with an adjacent web on each side. When interlocked, each pair of webs forms a pair of pockets into which an adjacent joist can be placed and held in position. Pre-drilled holes along the rims of the pocket provide locations for nailing the web securely to the joist.

The web may be made of carbon fiber or aluminum grade 2014-T6 or 2024-T6 for tensile strength meeting or exceeding fifteen pounds per square inch, for shearing strength meeting or exceeding twenty pounds per square inch, for corrosion resistance, and for minimal galvanic response, for use in environments ranging in temperature from minus two hundred degrees Fahrenheit to plus five hundred fifty degrees Fahrenheit.

The web may be constructed by creating a box frame using material 0.25 inch thick by 1.50 inches wide. The top of the frame may be fourteen inches in length. The bottom of the frame may be sixteen inches with two inches projecting to one side of the rectangle. The side dimensions may be sufficient for the top-to-bottom outside dimension (O.D.) of the rectangle to equal 9.375 inches. A second reinforcing rectangle 0.25 inch thick by 0.75 inch wide may be affixed and centered to the inside dimension (I.D.) of the first rectangle. Inside the second inner rectangle and filling the entire space may be a flat plate 0.25 inch thick with cutout spaces or openings as shown in the drawings. Other patterns of openings may be used. Cutouts generally conform to a standard so that closed circles are for electrical cable, slots ending in half-circles are for pipes, and remaining cutouts are for waste pipes and ductwork. Electrical cable, water pipes, gas pipes, waste pipes and ductwork are referred to herein as utility conduits.

A plurality of 0.25 inch diameter holes may be placed around all edges of the outer rectangle with four holes per edge on top and bottom and two holes per edge on both sides. Where the bottom outside projects two inches beyond the rectangle and flush with the edge, a "T" shaped nine inch length is affixed at ninety degrees and with the head of the "T" facing outward. In cross-section the "T" is one inch wide at the top of the "T" and 0.50 inch wide at the base of the "T," and 0.50 inch from top to base. The gap from the edge of the outer rectangle to the base of the "T channel is 1.50 inches which creates a slot correctly sized for a standard sized wood joist on end. On the end of the rectangle, projecting 0.50 inch from each edge is a 0.25 inch thick "L" shape with the base of the "L" to the outside and facing inward to create the mate for the "T" channel on the opposite end.

Except for the "L" shaped channel, the entire form is designed so that stamping or molded forming are feasible production methods, leaving a small cutting operation.

The entire form may be positioned three inches below joist top height in order to leave a nailing "punch through" safety zone and to allow space for notch back and plumbing needs for renovation and restoration jobs.

Figure 6:
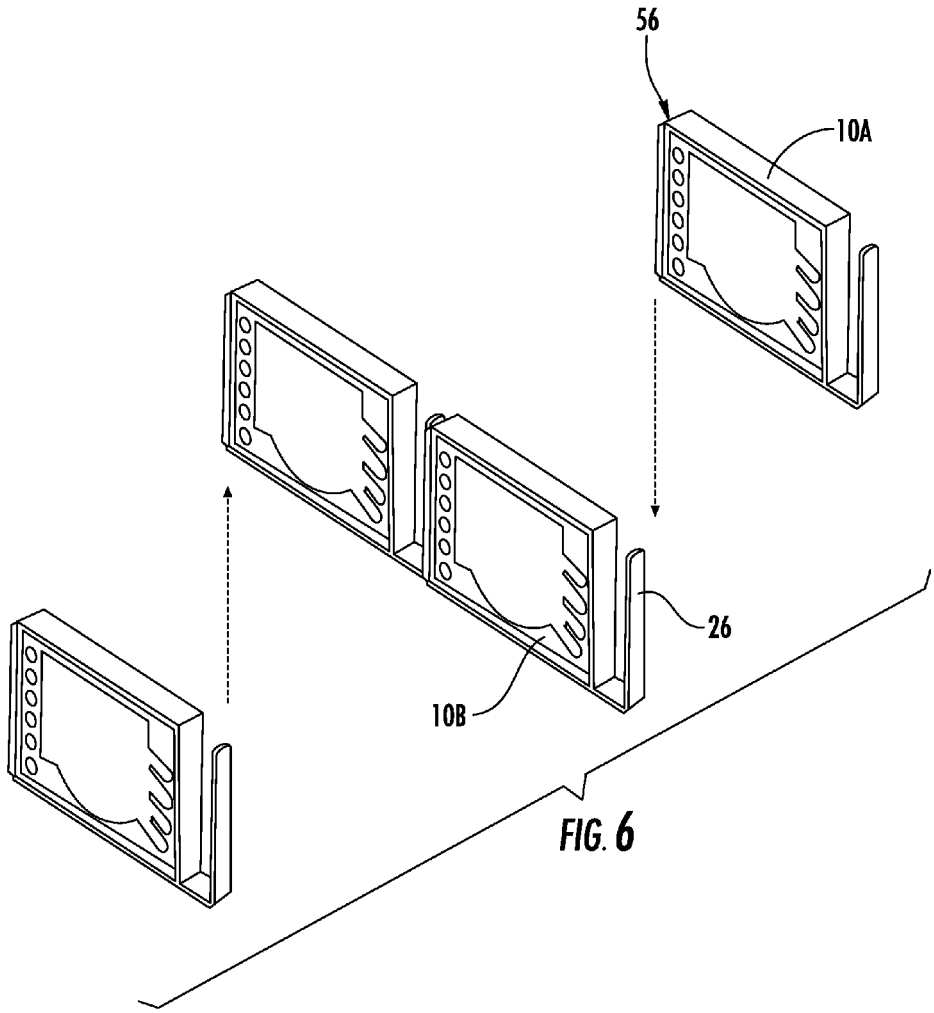
FIG. 6 is a perspective view of a plurality of the webs of FIG. 1 being joined together.
Figure 7:
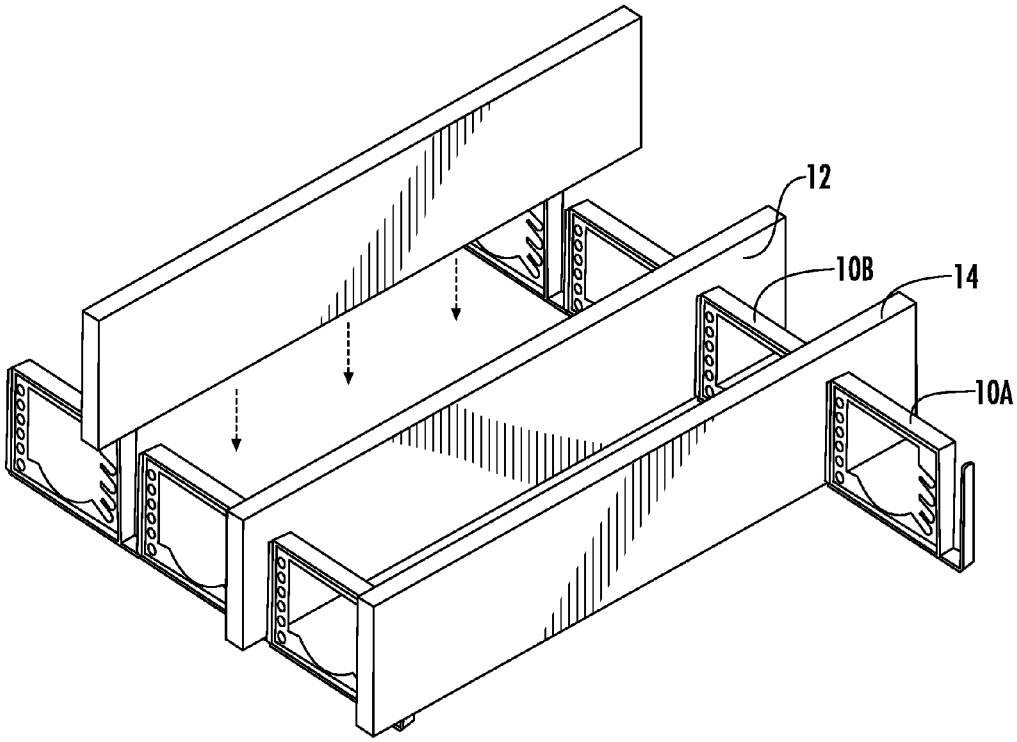
FIG. 7 is a perspective view showing a plurality of the webs of the embodiment of FIG. 6 and a plurality of floor joists and showing how the web and floor joists are combined together in a unified floor construction.

Referring now more particularly to FIGS. 1-8, there is provided web 10 which is adapted to bridge between parallel floor joists, such as floor joists 12 and 14 shown in FIG. 7. Web 10 includes box frame 16 having first and second opposing sides 18 and 20. Box frame 16 further includes top 22 and bottom 24. Vertical beam 26 is spaced apart from side 18 forming pocket 28. As can be seen in FIG. 7, pocket 28 receives a floor joist, such as floor joist 12. Preferably the height of web 10 and thus the height of pocket 28 is less than the height of the floor joist. Bottom 24 of web 10 extends beyond side 18 and forms floor 30 for pocket 28.

A reinforcing frame 32 is received within box frame 16. A central portion of web 10 in the form of plate 34 is attached to reinforcing frame 32. Plate 34 includes a plurality of cutouts or openings therein which are adapted to receive various elongated utility conduits, such as electrical cable, gas pipe, water pipe, waste pipe, and ductwork, such as HVAC ducts. As used herein, "opening" includes holes, slots and the like. Openings 36, which preferably receive electrical cable, include different sized holes to receive different diameters of electrical cable.

Plate 34 also includes a plurality of cutouts in the form of slots 38 which are specifically designed to receive water pipes and gas pipes. Preferably, the slots 38 are of different widths so as to receive different widths of gas pipes and water pipes. Plate 34 also includes a large opening 40 which is designed to receive waste pipe and/or HVAC conduit. Large opening 40 includes a lower curved portion 42 upon which the conduit or waste pipe rests.

Figure 4:
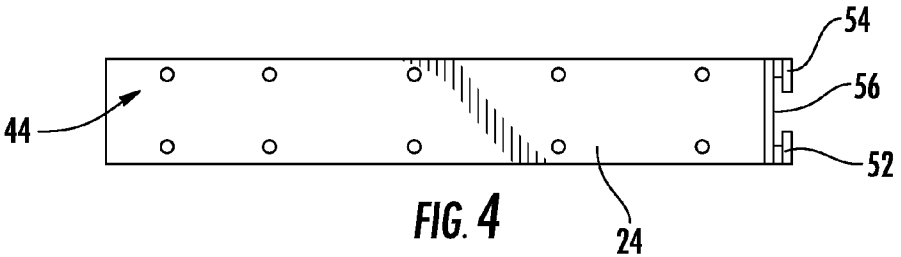
FIG. 4 is a bottom view of the embodiment of FIG. 1.

As previously indicated, the sides 18 and 20 and the top and bottom 22 and 24 include a number of holes. One or more of the holes 44 in bottom 24, as shown in FIG. 4, may be used to attach a drop ceiling to web 10. The holes 46 in side 18 and the holes 48 in side 20 are used for attaching web 10 to joists, such as joists 12 and 14, preferably by means of nails.

Beam 26 is "T" shaped with the head 50 of the "T" shape of beam 26 facing outwardly. A pair of "L" shaped flanges 52 and 54 extends from side 20 of web 10 forming channel 56.

As can be seen in FIG. 6, channel 56 of web 10A is adapted to receive beam 26 of web 10B. Beam 26 of web 10B and channel 56 of web 10A form a connector for holding the webs together. Webs 10A and 10B are identical. If joists 12 and 14 are on sixteen inch centers, then the width of bottom 24 of web 10 should be sixteen inches. As shown in FIG. 7, preferably, the plurality of webs are spaced apart along the joists forming rows of webs at three foot to six foot intervals. By integrating the webs with floor joists, a very strong floor structure is formed. The webs 10 are not only attached to the joists, they are also attached together.

Figure 8:
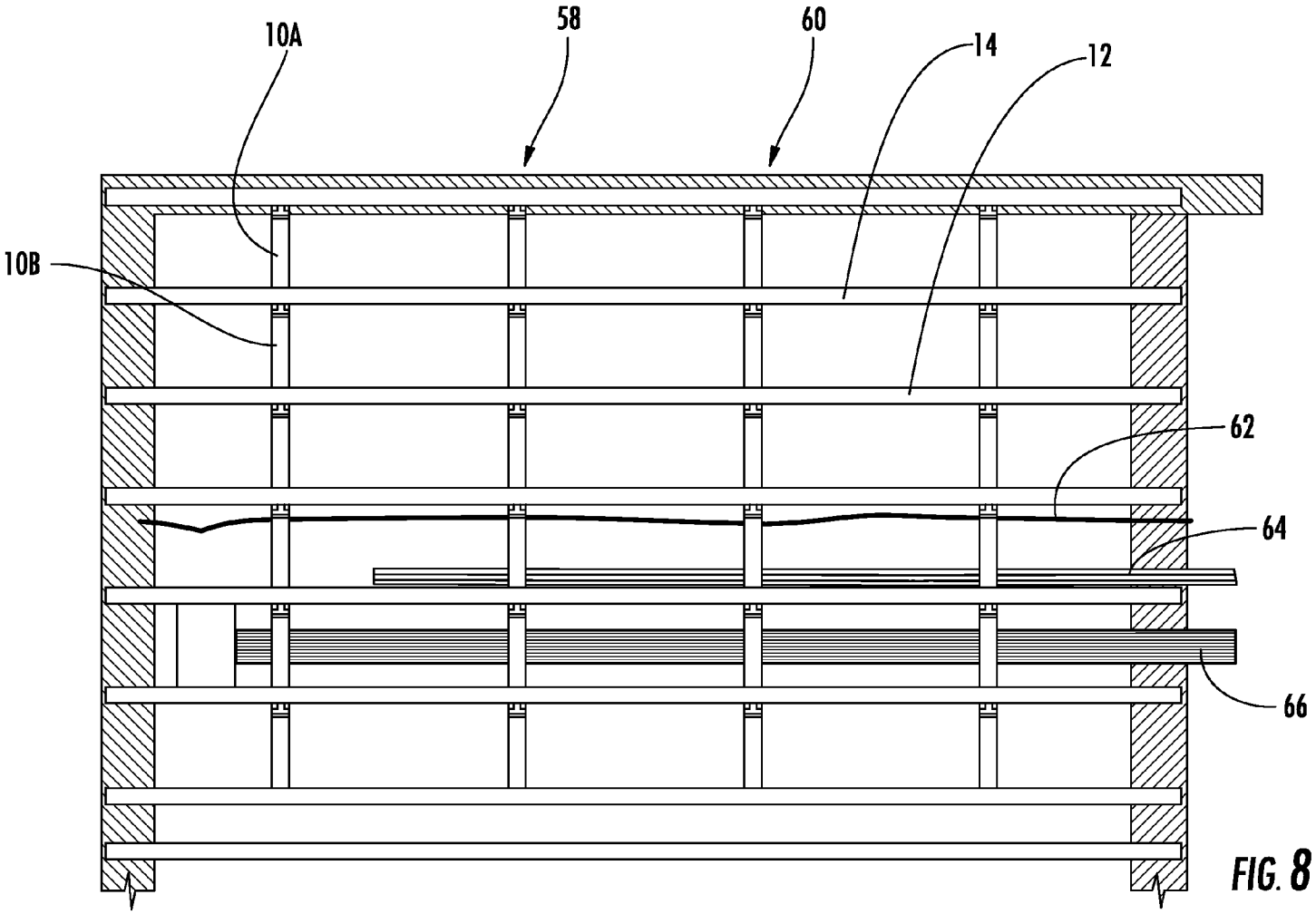
FIG. 8 is a bottom view of a plurality of floor joists and a plurality of webs of FIG. 1 attached together and to the floor joists with some of the webs receiving elongated utility conduits.

As can be seen in FIG. 8, adjacent rows 58 and 60 of interconnected webs are provided along the length of the joists. FIG. 8 also illustrates electrical cable 62, water pipe 64 and flexible duct 66 running through a plurality of spaced apart webs which are bridged between adjacent joists.

While the invention has been described in terms of the above embodiments, those skilled in the art will recognize that the invention can be practiced with modification within the spirit and scope of the appended claims.

The invention claimed is:

1. An apparatus for bridging between adjacent floor joists comprising:

a web having a first side, an opposing second side, a bottom, and a central portion;

an extension spaced from the first side of the web and connected to the web through a projection at the bottom of the web;

a pocket defined by the first side of the web, the projection at the bottom of the web, and the extension, the pocket configured to receive a floor joist;

the central portion including a plate; the plate having a plurality of openings therein; and each opening adapted to receive one of a plurality of elongated utility conduits.

2. An apparatus as set forth in claim 1 wherein one of the openings includes a hole adapted to receive electrical cable.

3. An apparatus as set forth in claim 1 wherein one of the openings includes a slot adapted to receive a water pipe or a gas pipe.

4. An apparatus as set forth in claim 1 wherein the opening is defined in part by a curved surface adapted to support a portion of ductwork or a waste pipe.

5. An apparatus as set forth in claim 1, wherein the pocket extends substantially along an entire length of the first side.

6. An apparatus as set forth in claim 1, wherein the extension is beam extending substantially parallel to the first side.

7. An apparatus as set forth in claim 1, wherein the projection is a portion of the bottom extending past the first side of the web.

8. An apparatus as set forth in claim 1 wherein the web is adapted to be perpendicular to the adjacent floor joists.

9. An apparatus as set forth in claim 1, wherein the second side includes a channel adapted to receive an extension from another web for holding the webs together.

10. An apparatus as set forth in claim 1 wherein the plurality of elongated utility conduits include electrical cables, water pipes, gas pipes, waste pipes and ductwork.

11. An apparatus as set forth in claim 5 wherein the length of the pocket is less than the height of the floor joist which is adapted to be received therein.

12. An apparatus as set forth in claim 1 wherein the plurality of openings includes a plurality of holes on one side of the plate for receiving electrical cable and a plurality of slots located on the other side of the plate for receiving pipes; a major opening in the plate located between the plurality of holes and the plurality of slots for receiving ductwork or waste pipe.

13. An apparatus as set forth in claim 9 wherein the extension is "T" shaped and the channel is also "T" shaped complimentary to the "T" shape of the extension.

14. An apparatus as set forth in claim 1, further including a plurality of holes in the first side and the second side which are adapted for use in fastening the web to adjacent joists.

15. An apparatus as set forth in claim 1 wherein the bottom includes at least one hole whereby a drop ceiling may be attached to the web.

16. An apparatus for strengthening floor structures and for organizing utility conduits comprising:

a rectangular shaped web having first and second opposing sides and a bottom; the web adapted to bridge between adjacent floor joists and being perpendicular to the adjacent floor joists;

a beam located a predetermined distance from the first side of the web and attached to the web through a projection at the bottom of the web; the beam being parallel to the first side; the beam and the first side forming a pocket for receiving at least a portion of a floor joist;

a channel formed in the second side for receiving a beam from another substantially identical web wherein the two webs may be interlocked; and the web including a central portion having a plurality of openings therein for receiving elongated utility conduits.

17. A floor joist strengthening and utility conduit organizing system comprising:

at least first and second webs;

each web having first and second opposing sides and a bottom;

each web having a central portion with at least one opening therein for receiving at least one elongated utility conduit;

a beam located a predetermined distance from the first opposing side of each web and attached to the web through a projection at the bottom of the web, the beam forming a pocket with the projection and the first side of the web for receiving at least a portion of a floor joist; and each web having a channel formed in the second opposing side; the channel of the first web receiving the beam of the second web wherein the first and second webs are interlocked.

18. A floor joist system as set forth in claim 17, further including first, second and third adjacent floor joists; the first web bridging the first and second floor joists and the second web bridging the second and third floor joists.

19. A floor joist system as set forth in claim 18 wherein the central portion of each web includes a plurality of openings, including holes and slots for receiving a plurality of elongated utility conduits.

20. A floor joist system as set forth in claim 17, further including at least third and fourth webs; the third web located a predetermined distance from the first web and the fourth web located a predetermined distance from the second web along the length of the floor joists whereby a plurality of rows of webs are formed and are connected to floor joists.

* * * * *